US009359707B2

(12) United States Patent
Bas

(10) Patent No.: US 9,359,707 B2
(45) Date of Patent: Jun. 7, 2016

(54) APPLIANCE CONTROL PANEL ASSEMBLY

(71) Applicant: Electrolux Appliances Aktiebolag, Stockholm (SE)

(72) Inventor: Alberto Bas, Sesto al Reghena (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 13/961,592

(22) Filed: Aug. 7, 2013

(65) Prior Publication Data

US 2015/0043135 A1 Feb. 12, 2015

(51) Int. Cl.
*D06F 39/00* (2006.01)
*D06F 39/12* (2006.01)

(52) U.S. Cl.
CPC ..... *D06F 39/005* (2013.01); *D06F 39/12* (2013.01)

(58) Field of Classification Search
CPC ..... D06F 39/005; D06F 39/14; D06F 39/12; D06F 37/20; A47L 15/4274; A47L 15/4265; F25D 29/005; H05K 5/03; Y10T 24/50; Y10T 292/0895; G09F 9/3023; H01H 2219/006; H01H 2231/012
USPC ..... 312/228, 265.5, 265.6, 263, 279; 68/3 R, 13 R, 212, 12.27
See application file for complete search history.

(56) References Cited

U.S. PATENT DOCUMENTS 3,253,874 A 5/1966 Czech
3,814,491 A * 6/1974 Kackley ..... 312/257.1
4,003,613 A * 1/1977 Oakley ..... 312/293.2
4,765,698 A * 8/1988 Dooley ..... 312/248
4,798,424 A * 1/1989 Coates et al. ..... 312/257.1
5,423,605 A * 6/1995 Liu ..... 312/265.6
5,611,609 A * 3/1997 Katz et al. ..... 312/263
5,611,610 A * 3/1997 Katz et al. ..... 312/263
5,685,623 A * 11/1997 Katz et al. ..... 312/263
5,738,424 A * 4/1998 Katz et al. ..... 312/293.3
6,234,593 B1 * 5/2001 Chen et al. ..... 312/223.2
6,371,583 B1 4/2002 Visin
6,671,179 B2 * 12/2003 Chen ..... 361/725
7,192,102 B2 * 3/2007 Park et al. ..... 312/265.5
7,395,683 B2 7/2008 Kim et al.
7,490,492 B2 * 2/2009 Kim et al. ..... 68/12.27
7,726,157 B2 * 6/2010 Lim et al. ..... 68/3 R
7,748,243 B2 * 7/2010 Park et al. ..... 68/196
7,789,238 B2 * 9/2010 Claypool et al. ..... 206/508
8,317,275 B2 * 11/2012 Han et al. ..... 312/228
2003/0067254 A1 * 4/2003 Manke et al. ..... 312/204
2004/0154909 A1 8/2004 Kim et al.
2005/0178164 A1 * 8/2005 Kim et al. ..... 68/3 R
2005/0179347 A1 * 8/2005 Kim et al. ..... 312/228
2005/0225218 A1 * 10/2005 Cheo et al. ..... 312/279

(Continued)

*Primary Examiner* — Daniel J Troy
*Assistant Examiner* — Hiwot Tefera
(74) *Attorney, Agent, or Firm* — Banner & Witcoff, Ltd.

(57) ABSTRACT

An appliance control panel assembly is provided including an upper fascia part and an angled lower base part. The control panel assembly may attach to the top surface of an appliance, such as a laundry machine, and may be removable. The upper fascia part may be configured to be slidably engaged to the angled lower base part and releasably connected to the angled lower base part by one or more flexible hooks and hook seats. The flexible hooks may be located on either the upper fascia part or the angled lower base part. The control panel assembly may also include disassembly holes through which an instrument can be inserted to deform the hooks and disconnect the upper fascia part from the angled lower base part.

26 Claims, 11 Drawing Sheets

(56) References Cited

U.S. PATENT DOCUMENTS

| | | | | |
|---|---|---|---|---|
| 2005/0257574 | A1* | 11/2005 | Lyu | 68/3 R |
| 2005/0257577 | A1 | 11/2005 | Lyu | |
| 2007/0006485 | A1* | 1/2007 | Kim | 34/603 |
| 2007/0169520 | A1 | 7/2007 | Heo | |
| 2007/0266742 | A1 | 11/2007 | Yoon et al. | |
| 2008/0053159 | A1 | 3/2008 | Hwang et al. | |
| 2008/0229789 | A1* | 9/2008 | Kim et al. | 68/12.01 |
| 2009/0091222 | A1 | 4/2009 | Jang et al. | |
| 2009/0126419 | A1* | 5/2009 | Yoon et al. | 68/212 |
| 2009/0153004 | A1* | 6/2009 | Han et al. | 312/228 |
| 2013/0241375 | A1* | 9/2013 | Matsumura | 312/223.1 |

* cited by examiner

APPLIANCE CONTROL PANEL ASSEMBLY

TECHNICAL FIELD

The present disclosure relates generally to a control panel assembly for appliances, such as washing machines and dryers.

BACKGROUND

Many appliances such as laundry machines are controlled by a control panel located on an outside surface of the machine. Generally, the control panel displays information including machine status and washing/drying cycle options. The control panels of many laundry machines are permanently affixed to the outside surface of a cabinet during the manufacturing process, often through the use of hardware such as screws or bolts. Routine maintenance or diagnosing problems with the laundry machine may require removal of the control panel. The amount of time and expertise required to safely remove the control panel of many appliances may be problematic due to their permanent attachment.

Even in appliances without permanently attached control panels, removing a control panel may be difficult. Wiring connecting the appliance to the instrumentality on the control panel is often difficult to work around and may have to be removed prior to maintenance, especially if the control panel needs to be replaced by a new part. Furthermore, a control panel that is completely removed from the appliance leaves exposed vulnerable parts and instrumentality that subsequently may be damaged during maintenance.

In addition to the challenges associated with assembly and disassembly of control panels on various appliances, the control panels of many appliances are made up of many parts which are costly to manufacture due to tooling costs for unique parts. A complex molding process may lead to weaknesses in some control panel parts. In some cases, weaknesses in control panel parts may result in breakage over time, especially when the control panel is installed on appliances, such as laundry machines (e.g., washers and dryers), that are designed to perform functions that cause frequent and/or strong vibrations. Further, the proliferation of appliance parts requires many appliance manufacturers to keep a constant supply of parts for current machines and costs for storage and replacement of parts are often passed on to consumers.

BRIEF SUMMARY

The above and other drawbacks of existing appliance control panels may be addressed by aspects of the present disclosure. The following presents a simplified summary of various aspects described herein. This summary is not an extensive overview, and is not intended to limit or constrain the detailed description or claims.

According to one aspect of the disclosure, a control panel assembly comprising an upper fascia part and an angled lower base part is provided. The control panel may attach to the top surface of a body of an appliance, such as a laundry machine cabinet. The upper fascia part may be slidably engaged to the angled lower base part and releasably connected to the angled lower base part by one or more flexible hooks and hook seats. The flexible hooks may be located on either the upper fascia part or the angled lower base part. Disassembly holes corresponding to each flexibly hook/hook seat may be located on the angled lower base part.

The control panel can be assembled by aligning the upper fascia part and the angled lower base part and subsequently inserting the flexible hooks into hook seats. The flexible hooks and hook seats provide a connection that secures the upper fascia part to the angled lower base part. In this configuration, the parts might not slide apart and instead may be securely fastened.

The control panel can be disassembled by inserting an instrument (e.g., a screwdriver or other long, thin object) into a disassembly hole, thereby deforming the flexible hook. This action may free the flexible hook from the hook seat, and after all flexible hooks are freed, the upper fascia part can be slid off the angled lower base part. This disassembly process may be performed by a single user. The user may use one hand to press an instrument against the flexible hook thereby removing it from its respective hook seat, and use his/her other hand to slide the upper fascia part off the angled lower base part. In some cases, this disassembly process may be performed without having to move the entire appliance.

The above and other features, aspects, and advantages of the present disclosure will be readily apparent and fully understood from the detailed description below, taken together with the accompanying drawings.

BRIEF DESCRIPTION OF THE DRAWINGS

The present disclosure is illustrated by way of example, and not limited by, the accompanying drawings in which like reference numerals indicate similar elements.

DETAILED DESCRIPTION OF EXAMPLE EMBODIMENTS

In the following description of the various embodiments, reference is made to the accompanying drawings, which form a part hereof, and in which is shown, by way of illustration, various embodiments in which aspects described herein may be practiced. It is to be understood that other embodiments may be utilized and structural and functional modifications may be made without departing from the scope of the present disclosure.

Figure 1:
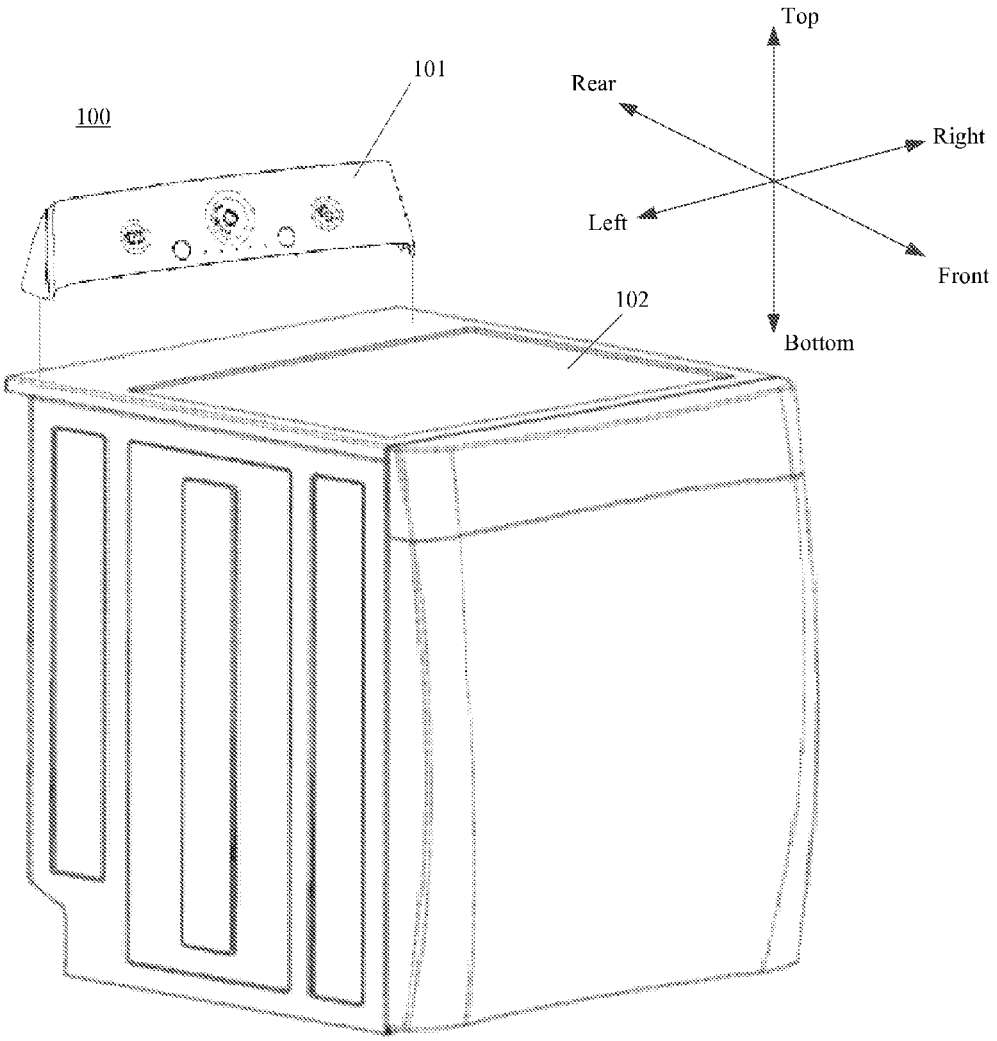
FIG. 1 is a perspective view of an example embodiment of a laundry machine with a control panel assembly that attaches to an outside surface of the laundry machine.

Referring to FIG. 1, a laundry machine 100 according to one aspect of the disclosure is depicted. The laundry machine 100 may include a control panel assembly 101 and a laundry machine cabinet 102. The control panel assembly 101 may connect to the outside surface of the laundry machine cabinet 102. In this example, the laundry machine 100 is depicted as a top loading washing machine, but the control panel assembly 101 may be connected to other laundry machines including front loading washers, dryers, or combination washer/dryer units. The control panel assembly 101 can be mounted on the laundry machine cabinet 102 through the use of bolts or screws, or with hooks protruding from the underside of the control panel assembly 101. The control panel assembly 101 may be removed from the laundry machine cabinet 102. Thus, if, for example, the control panel assembly 101 malfunctions, the control panel assembly 101 may be replaced. The control panel assembly 101 may also provide an easily accessible point to perform maintenance on the underlying appliance, if, for example, wiring of the appliance is passed through the control panel assembly 101. Further, if parts of the control panel assembly 101 become damaged or malfunction, the control panel assembly 101 may be removed to allow repair.

Although FIG. 1 illustrates the control panel assembly 101 attached to a rear-top portion of the laundry machine cabinet 102, in other embodiments, the control panel assembly 101 may be attached to other portions of the laundry machine cabinet 102. Still, in some cases, the control panel assembly 101 might not be structurally connected to an appliance, and instead may simply be electrically connected. For example, the control panel assembly 101 may be attached to a shelf or wall and may control operations of an appliance via wired (or wireless) connections.

The control panel assembly 101 may function as a user interface for the appliance to which it is attached. In particular, the control panel assembly 101 may be configured to display information including machine status and washing/drying options. In some embodiments, the control panel assembly 101 may include one or more light emitting diodes (LEDs) and/or a screen, such as an LCD screen or touch-screen, for displaying information to the user. The control panel assembly 101 may also act as a housing for a controller (e.g., a microcontroller), which may include various circuitry (e.g., integrated circuits) and/or other computing devices (e.g., memory and processors). Accordingly, the control panel assembly 101 may be configured from a material or in a manner such that it is sufficiently resilient to protect the devices (e.g., controller) therein.

Figure 2:
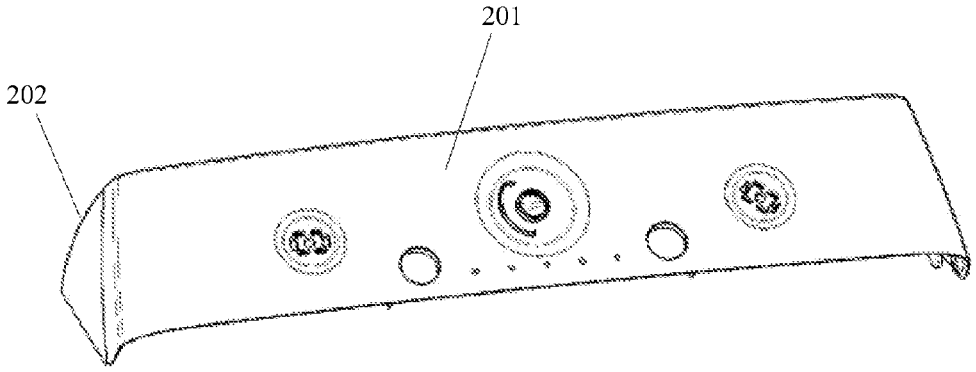
FIG. 2 is a front perspective view of the control panel assembly comprising the upper fascia part and attached angled lower base part.

FIG. 2 shows the control panel assembly 101 separated from the rest of the laundry machine 100. The control panel assembly 101 may comprise two parts: an upper fascia part 201 and an angled lower base part 202. The angled lower base part 202 may comprise a curved back panel and two triangular sides that form an angled opening, as well as a horizontal plate 403 that may provide structural strength to the angled lower base part 202 (shown in FIG. 4). The angled opening may be angled toward the front of the appliance (e.g., laundry machine 100) to facilitate inspection and access by the user when mounted on the laundry machine cabinet 102. The measure of angle $\alpha$ on the triangular side of the angled lower base part 202 is shown as an example at approximately 45 degrees from horizontal, although angle $\alpha$ can measure between 0 and 90 degrees. Typically, angle $\alpha$ may be between 25 and 80 degrees.

The upper fascia part 201 and angled lower base part 202 connect together securely during operation of the appliance and might not be inadvertently separated by vibrations produced by the appliance. Both the upper fascia part 201 and angled lower base part 202 are removable for maintenance. In addition, the upper fascia part 201 may be removed while leaving the angled lower base part 202 connected to the laundry machine cabinet 102. This may allow a new upper fascia part 201 to be replaced without having to disconnect wiring or instrumentality connected to the angled lower base part 202 and may shorten maintenance and replacement time. Leaving the angled lower base part 202 connected during maintenance may also protect delicate wiring and instrumentality from harmful contact or water or dust ingress during the maintenance process. The various indentations, receptacles, recesses, holes, etc. in the upper fascia part 201 allow for the introduction of one or more command input devices, such as knobs, dials, LEDs, push-buttons, voice receivers, touch screens, etc., that allow a user to interface with the underlying appliance. Electrical wiring may connect the laundry machine to the various devices or instrumentality on the control panel assembly 101 to provide status information as well as a user interface for controlling operation of the laundry machine.

Figure 3:
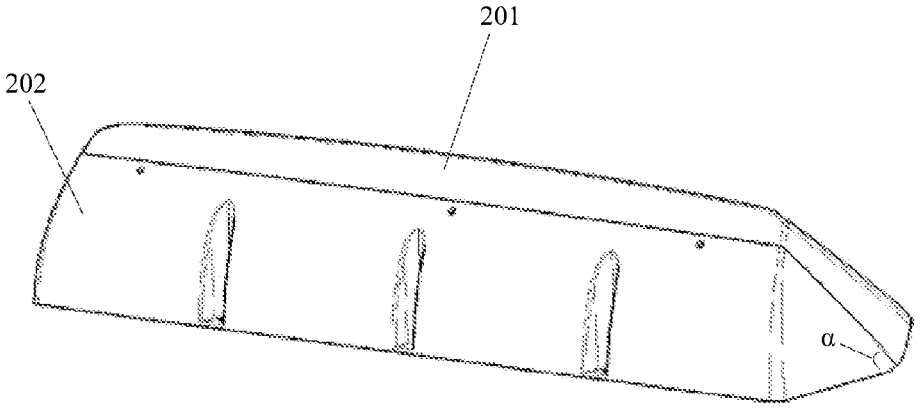
FIG. 3 is a rear perspective view of the control panel assembly.

FIG. 3 shows a rear perspective control panel assembly 101 with the upper fascia part 201 connected to the angled lower base part 202. The upper fascia part 201 and angled lower base part 202 may be formed by molding plastic or other like materials. A single mold or two separate molds may be used for forming the upper fascia part 201 and the angled lower base part 202. If two separate molds are used, the molds may be shaped so that the upper fascia part 201 and angled lower base part 202 are configured to fit with one another. When connected properly, the two parts may form a flush connection in which edges of the upper fascia part 201 fit against edges of the angled lower base part 202 without a gap therebetween. This flush connection may protect parts on the inside of the control panel assembly (including wiring) from dust or water ingress, as well as protecting a user from sharp corners or exposed parts. The flush connection may also minimize the risk of separation when the control panel assembly is subjected to vibrations produced by the appliance or other appliances nearby.

Figure 4:
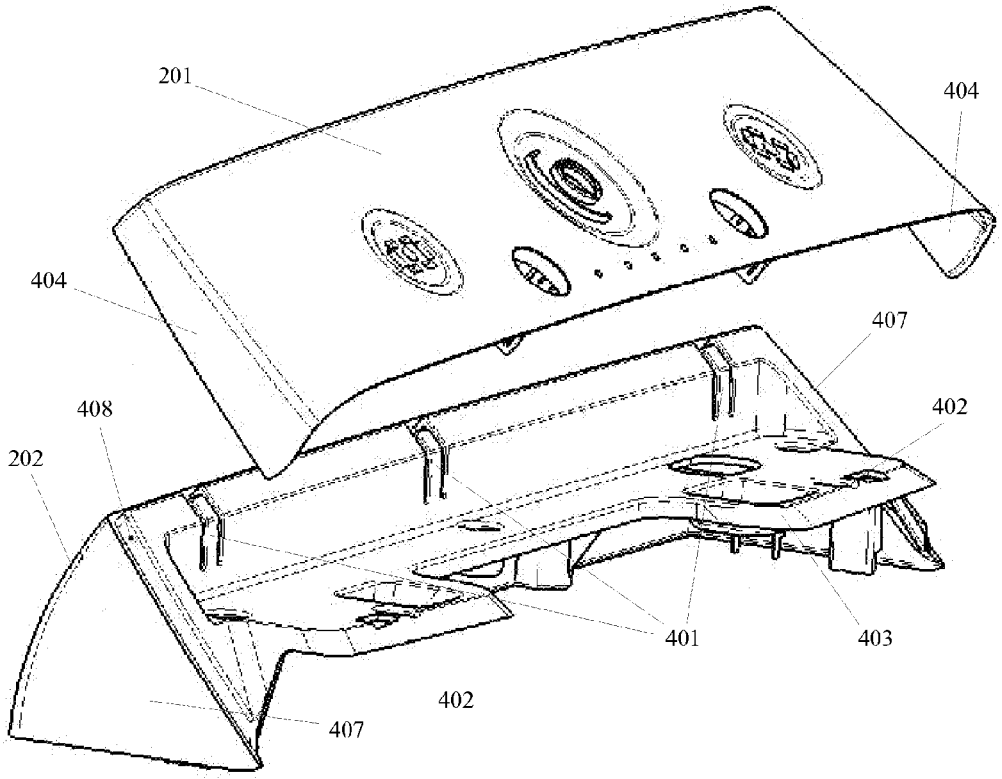
FIG. 4 is a side perspective view of the control panel assembly, with the upper fascia part disconnected from the angled lower base part.

A more detailed view of the upper fascia part 201 and the angled lower base part 202 can be seen in FIG. 4, where the parts are separated. The upper fascia part 201 may be connected to the angled lower base part 202 by a plurality of coupling devices (or connecting devices). Coupling devices may comprise flexible hooks 401 and hook seats 501. A number of flexible hooks 401 are located on a surface of the lower angled base part 202, but they may also be located on a surface of the upper fascia part 201. Three flexible hooks 401 are shown in FIG. 3, however, the number of flexible hooks 401 is variable. The flexible hooks 401 may be made from a material that is resiliently deformable, facilitating disassembly of the constituent parts. As mentioned above, the angled lower base part 202 may be formed by molding plastic or other like materials. The mold may be configured to form the flexible hooks 401 as well so that the flexible hooks 401 may be integrated with the angled base part 202. As such, the flexible hooks 401 may protrude from and extend upward from the inside of a curved back wall or horizontal plate 403 of the angled lower base part 202. The flexible hooks 401 may be included in the molding process for either the upper fascia part 201 or angled lower base part 202 and might not be detachable, resulting in a unified (or integrated), one-part design. This may allow the control panel assembly 101 to comprise only two parts instead of multiple connecting parts. Specifically, each of the flexible hooks 401 may be formed of a thin plastic material having a basal end integrated with the angled lower base part 202. The basal end of the flexible hook 401 may be integrated with the horizontal plate 403 or curved back wall of the angled lower base part 202.

A flexible hook 401 may comprise two integrated or connected arms, a lower arm and an upper arm, where the lower arm may protrude from the angled lower base part 202 or alternatively from the upper fascia part 201. In some cases, the lower arm may be longer than the upper arm. The upper arm may extend at an angle from the lower arm and may include a tip that may have a wedge profile at its end furthest from the lower arm. Each flexible hook 401 may extend from the basal end inward away from the curved back wall of the angled lower base part 202 in a front direction and then upward toward a top edge of the curved back wall of the angled lower base part 202. As a result, respective tip ends of the flexible hooks 401 may be separated from the top edge of the curved back wall of the angled lower base part 202 so as to receive corresponding hook seats 501.

Further, FIG. 4 shows a side perspective view of the disconnected upper fascia part 201 and angled lower base part 202. From this view, side walls 404 of the upper fascia part 201 can be clearly seen. The side walls 404 may be located on the left and right ends of the upper fascia part 201. The side walls 404 may align with the outer edges 407 of the angled lower base part 202 when the control panel is assembled. FIG. 4 also depicts an internal wall 408 and the horizontal plate 403 of the angled lower base part 202. The internal wall 408 may regulate side-to-side (e.g., left-to-right) movement of the flexible hooks 401. The horizontal plate 403 provides support to the curved back wall and triangular sides of the angled lower base part 202. The horizontal plate protrudes forward past the angled opening so as to provide a flush connection with the upper fascia part 201. Clip seats 402 may be located on the angled lower base part 202 and may be small receptacles that form a depression within the horizontal plate 403. In various embodiments, however, the clip seats 402 may be located on either the upper fascia part 201 or the lower angled base part 202. The clip seats 402 may receive the clips 502 (seen in FIG. 5) that are located on the opposite part (in this example the upper fascia part 201). Together the clip seats 402 and clips 502 may provide references for positioning the two parts and a secondary connection between the two parts in addition to the connection of the flexible hooks 401 and hook seats 501. This secondary connection reinforces the overall connection between the two parts by preventing shifting of the constituent parts relative to each other and may be especially useful in preventing separation or damage of parts in laundry machines that undergo vibrations during various cycles.

Figure 5:
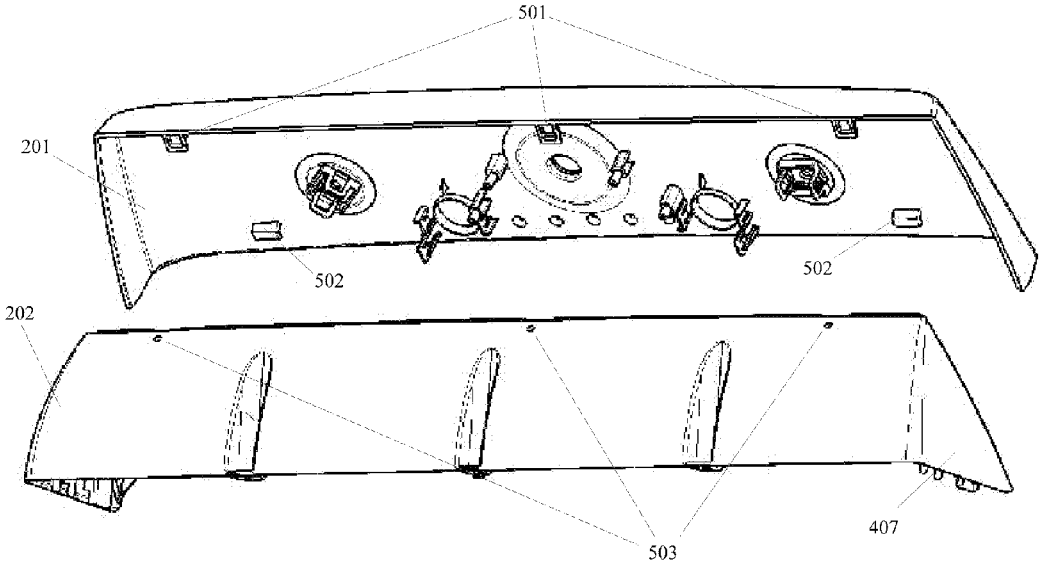
FIG. 5 is a rear perspective view of the control panel assembly, with the upper fascia part disconnected from the angled lower base part.

FIG. 5 provides more details on the connection mechanism of the control panel assembly 101. The flexible hooks 401 of FIG. 4 are inserted into hook seats 501. Several hook seats 501 are shown located on the upper fascia part 201 as an example, although they may also be located on the angled lower base part 202. The hook seats 501 may form a hollow rectangular (or square) shape, with the bottom side comprising an inclined plane part, e.g., an inclined surface (see FIG. 9), which corresponds with an inclined plane part on the flexible hook 401. This square shape may provide extra stability during connection of the upper fascia part 201 and angled lower base part 202 by ensuring that the flexible hook 401 is seated securely and is bounded by the hook seat 501. In addition, the open portion of the hollow square shape of the hook seat 501 may be slightly larger than the width of the flexible hook 401 to provide a snug fit when the two are latched together. Although the hook seats 501 are illustrated as having a rectangular or square shape, in some embodiments, the hook seats 501 may be formed to have other shapes, such as a circular or triangular shape.

Clips 502 are also seen located on the bottom side of the upper fascia part 201. The clips 201 may protrude out from upper fascia part 201 in this example and may alternatively protrude out of the angled lower base part 202. The clips 502 may be aligned with the clip seats 402 during connection of the upper fascia part and angled lower base part to provide a secondary connection as described earlier, as well as to ensure alignment of the flexible hooks 401 and hook seats 501. Several disassembly holes 503 may be used to disconnect the upper fascia part 201 and angled lower base part 202 as further discussed below. FIG. 5 illustrates the disassembly holes 503 being disposed on the angled lower base part 202, however, in some embodiments, the disassembly holes 503 may be disposed on the upper fascia part 201.

Figure 6:
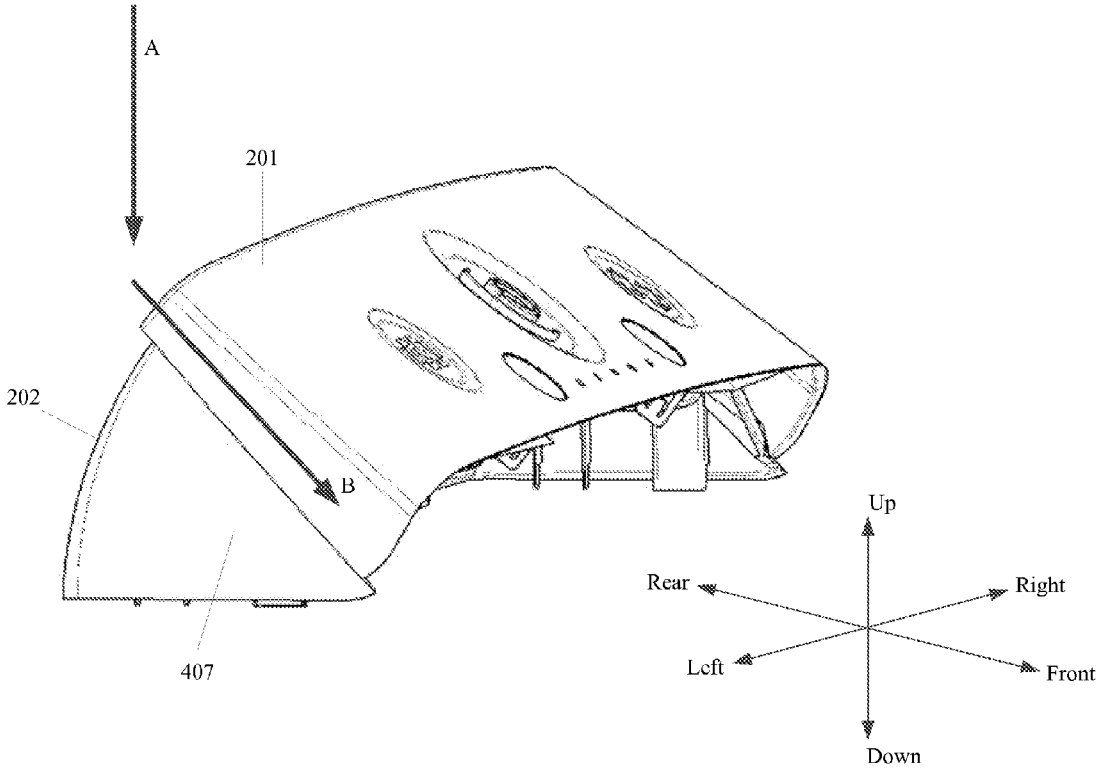
FIG. 6 is a side perspective view of the control panel with the upper fascia part nearly connected to the angled lower base part.

To attach the upper fascia part 201 and angled lower base part 202, the parts may be oriented as shown in FIG. 6. This orientation allows for alignment of the flexible hooks 401 with the hook seats 501, as well as alignment of the clips 501 and clip seats 402. The upper fascia part 201 and angled lower base part 202 may be shaped to prevent connection of the two parts unless the hooks 401 and hook seats 501 are correctly aligned. Prior to attachment of the upper fascia part 201 and angled lower base part 202, the angled lower base part 202 may be attached to the laundry machine cabinet 102 to provide a solid base for the attachment of the upper fascia part 201. Alternatively, the parts may be attached prior to attachment to the laundry machine cabinet 102.

To connect the upper fascia part 201 to the angled lower base part 202, the parts may be aligned to ensure that the hook seats 501 are located directly above the hooks 401 and the clips 502 are located directly above the clip seats 402. This alignment may require the upper fascia part 201 to be moved in a downward motion as shown by arrow A. At this point, the upper fascia part 201 may rest upon the angled lower base part 202 without latching the various connecting devices. Both the side walls 404 of the upper fascia part 201 and the internal wall 408 of the angled lower base part 202 may help with the alignment of the various parts of the control panel assembly 101. The side walls 404 may align with the outer edges 407 of the angled lower base part 202 providing a flush surface when the parts are aligned properly and contact each other. The internal wall 408 (see also FIGS. 4 and 9) of the angled lower base part 202 further comprises walls 405 that may regulate movement of the flexible hooks 401 and hook seats 501 in a left-to-right direction thereby assisting in the alignment of the parts. The walls 405 may provide a guide for each flexible hook 401 and hook seat 501 pair to come together.

Figure 7:
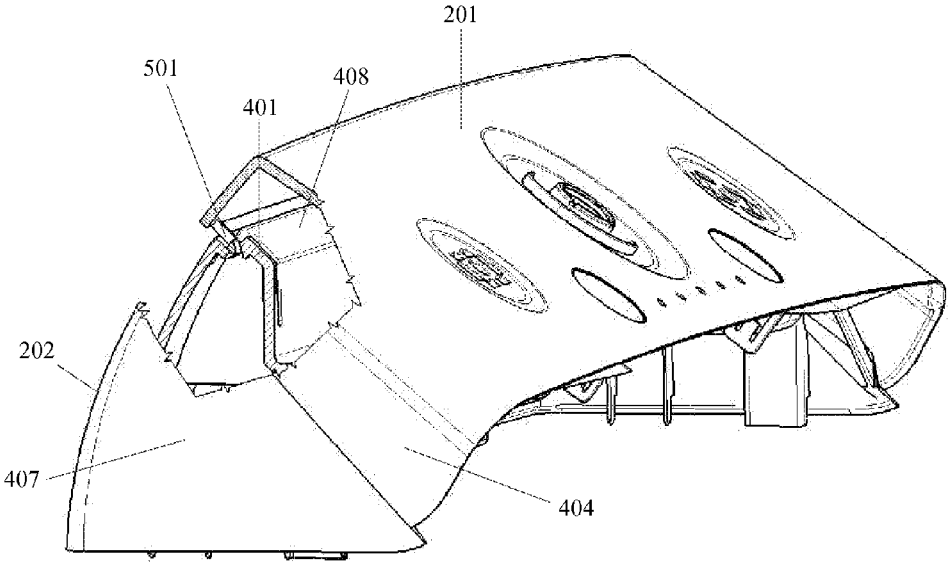
FIG. 7 is a cutaway view of FIG. 6 showing the location of the flexible hook, hook seat, and disassembly hole.

After alignment, the upper fascia part 201 may be slid in a front-down direction at an angle represented by arrow B, which latches the flexible hooks 401 to the hook seats 501 and the clips 502 to the clip seats 402. The direction of arrow B may be toward the front of the control panel at an angle from 0 to 90 degrees downward from horizontal. In some embodiments, the angle may be from 25 to 80 degrees downward from horizontal. The latching of the hooks 401 and hook seats 501 may involve a wedging action between the tips of the hooks 401 and hook seats 501 and is shown in FIG. 7 and discussed in further detail below. The clips 502 and clip seats 402 may latch in a distinct method from that of the hooks 401 and hook seats 501, because the clips 502 may simply slide into the clip seats 402 and may be held in place by friction. After the sliding motion shown by arrow B and subsequent latching between the various connecting devices, the side walls 404 of the upper fascia part 201 and outer edges of the angled lower base part 202 may form a flush connection.

The sliding motion in the direction of arrow B may be advantageous to a user located on the front side of the appliance because he/she can check the alignment of parts on both sides of the control panel assembly. In addition, sliding the upper fascia part 201 towards oneself at an angle may require less force and/or improve accessibility than if the part was designed for sliding in other directions. In addition, the angled sliding motion in the direction of the user allows the user to check that all wiring and instrumentality is securely within the control panel assembly before the parts are connected, lessening the risk of damage to wiring or injury due to pinched extremities.

It may be possible to connect all connection devices simultaneously or nearly simultaneously (such as while moving the upper fascia part 201 down onto the angled lower base part 202). Alternatively, connecting several connection devices at separate times may require a specific order of connection. For example, in the case of using three connection pairs, connecting the flexible hook 401 and hook seat 501 located in the center of the control panel assembly may provide additional stability and more precise alignment for connection of flexible hooks 401 and hook seats 501 located on the left and right edges. Or, for example, the connection pairs may be connected one at a time in order from left-to-right or right-to-left. When the connection devices are connected separately, the material of the upper fascia part 201 and angled lower base part 202 may deform slightly to allow some of the connection devices to be latched while others remain unlatched. Likewise, when all connection devices are connected and disassembly is desired, one or more connection devices may be disconnected while the others remain connected. This gradual disassembly may be facilitated by deformation of the material in the various control panel assembly parts. Gradual disassembly may be advantageous in allowing a single user to disassemble the control panel assembly 101 by unlatching connection devices one at a time. This process of gradual disassembly may also eliminate the need for more than one thin instrument 900 (see FIG. 11) to decouple the connection devices.

In some embodiments, the upper fascia part 201 may be connected to the angled lower base part 202 through the use of a single connection device. For example, a single thin flexible hook 401 may be seated within a single hook seat 501 in a middle section of the control panel assembly (e.g., at a section that is approximately equidistant from the left and right edges). A single connection device may provide sufficient latching strength to keep the parts of the control panel assembly connected and lessen the time required for assembly or disassembly of the control panel assembly 101. A design incorporating a single connection device may also decrease part complexity, lending added structural strength to parts in the control panel assembly and decreasing molding costs. Alternatively, a single, wide flexible hook 401 may be seated within a single widened hook seat 501, spanning a sufficient portion of the control panel assembly to provide stability. Again, this single connector configuration could lend sufficient connection strength while minimizing part complexity or assembly/disassembly time.

FIG. 7 shows a cutaway view of the alignment of the flexible hooks 401 and hook seats 501 before the parts are latched together. The cutaway view shows only one half of the hook seat 501, which may constitute a hollow square shape with the bottom side shaped like a wedge or inclined plane. Before connection of the parts, the hook seats 501 rest in the groove between the curved back part of the lower angled base part 202 and the hooks 401. The ability to rest the upper fascia part 201 on the angled lower base part 202 before connecting the parts together may be helpful to provide time and stability to the user to align the necessary parts and avoid a misconnection.

Figure 8:
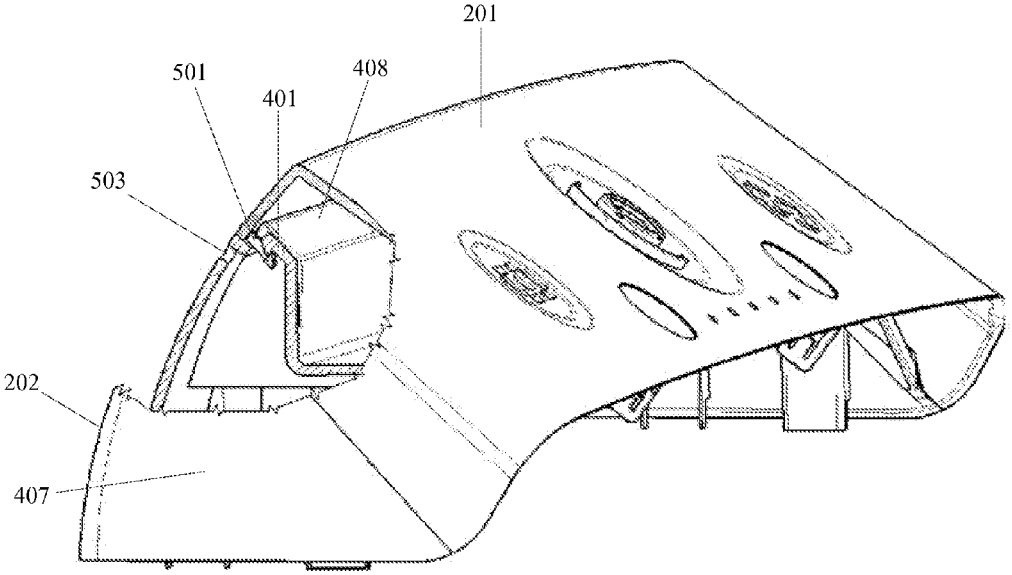
FIG. 8 is a cutaway view of the control panel with the upper fascia part completely connected to the angled lower base part, showing the location of the flexible hook, hook seat, and disassembly hole.

FIG. 8 shows a cutaway view of the upper fascia part 201 after sliding onto and connecting with the angled lower base part 202. The flexible hooks 401 have been inserted into the hook seats 501. At this stage, the flexible hooks 401 and hook seats 501 are connected to form a latching mechanism to hold the upper fascia part 201 to the angled lower base part 202. As such, a user cannot simply pull the upper fascia part 201 away from the angled lower base part 202. This secure connection prevents accidental separation of the control panel assembly 101. It also prevents the control panel assembly 101 from shifting or separating when subjected to vibrations produced by the connected laundry machine or nearby appliances, and ensures that potentially delicate parts located within the control panel assembly 101 are not damaged by water or dust ingress or by harmful contact with other parts. Also visible in FIG. 8 is a disassembly hole 503 which matches up with each combination of flexible hook 401 and hook seat 501.

Figure 9:
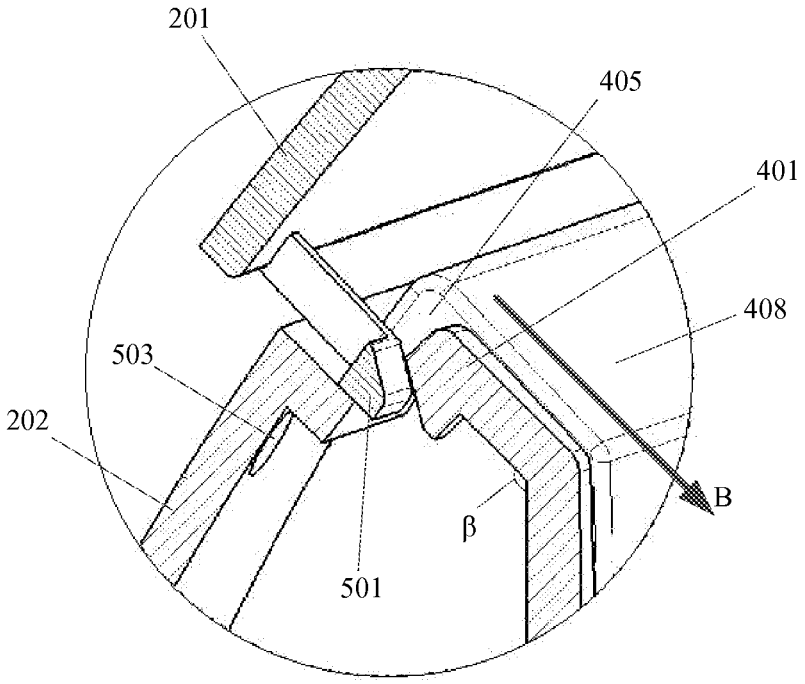
FIG. 9 is a close up view of FIG. 7, showing the location of the flexible hook, hook seat, and disassembly hole just before the upper fascia part is connected to the angled lower base part.

FIG. 9 shows a close-up cutaway view of the control panel assembly process where the upper fascia part 201 is aligned with the angled lower base part 202 but not connected. The cutaway view only shows one half of the hook seat 501 which may form a hollow square shape, with the lower edge forming a wedge shaped profile. The flexible hook 401 comprises two connected arms: a lower arm which extends from the basal end of the flexible hook 401 and an upper arm which extends from the end of the lower arm towards the back curved back of the angled lower base part 202. The lower arm forms an angle β with the sliding direction B of the upper fascia part 201 onto the lower base part 202. Angle β is shown at approximately 135 degrees as an example, but may measure between 0 and 180 degrees. In FIG. 9, the upper arm extends in a direction parallel to the sliding direction B. However, the upper arm may extend in a direction angled relative to the sliding direction B. The lower arm may be constructed of material thicker than that of the upper arm to be able to accommodate pressure applied during the disassembly process as discussed below. The upper arm may be constructed of thinner material to afford flexibility during the assembly process. Alternatively, both the lower arm and upper arm may be constructed of materials of similar thicknesses. FIG. 9 also illustrates the wedge shaped profile of the tip of the upper arm of the flexible hook 401.

The assembly process requires alignment of the hook seat 501 and flexible hook 401. The hook seat 501 initially rests on the flexible hook 401. Next, the upper fascia part 201 is moved downward at an angle (see FIG. 6) in relation to the lower angled base part 202. This sliding motion causes the bottom wedge part of the hook seat 501 to contact the upper wedge part of the flexible hook 401. The contact between the parts causes a slight deformation in one or both of the parts as the wedges slide past each other. After the parts have slid past each other, the upper wedge part of the flexible hook 401 relaxes to its normal shape due to mechanical resistance of the flexible hook 401 and is then bounded by the hook seat 501.

Figure 10:
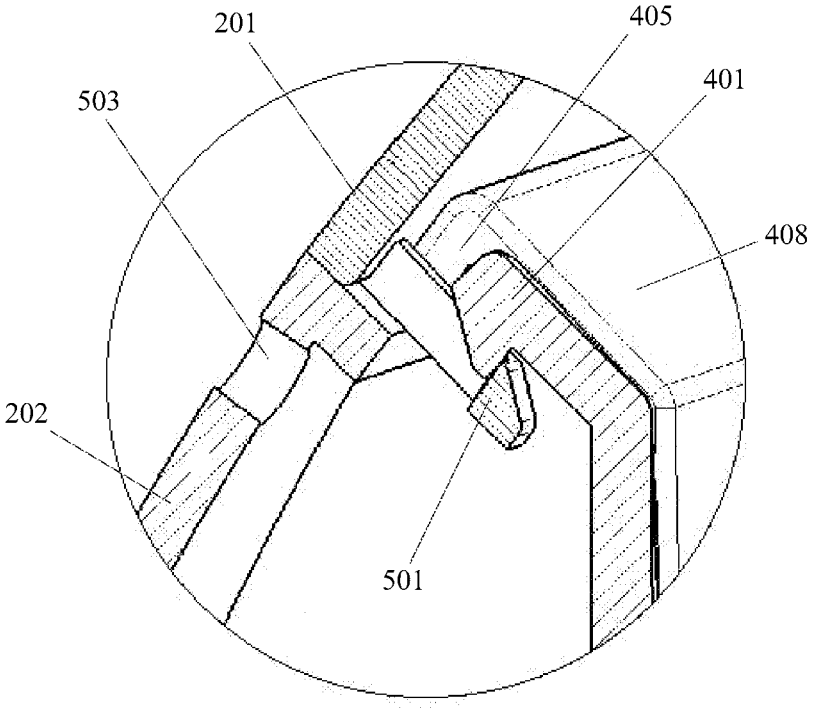
FIG. 10 is a close up view of FIG. 8, showing the location of the flexible hook, hook seat, and disassembly hole where the upper fascia part is completely connected to the angled lower base part.

FIG. 10 shows the flexible hook 401 after it has been inserted into the hook seat 501. At this point, the bounded upper wedge part of the flexible hook 401 might not be able to shift from either side-to-side or up-and-down thereby providing a stable connection for the entire control panel assembly 101. Also, the flat inside surface of the lower wedge part of the hook seat 501 may be in contact with the flat inside surface of the upper wedge part of the flexible hook 401. This contact may provide tension between flexible hook 401 and hook seat 501 in the event that they are pulled apart, preventing the flexible hook 401 from sliding past the hook seat 501.

Figure 11:
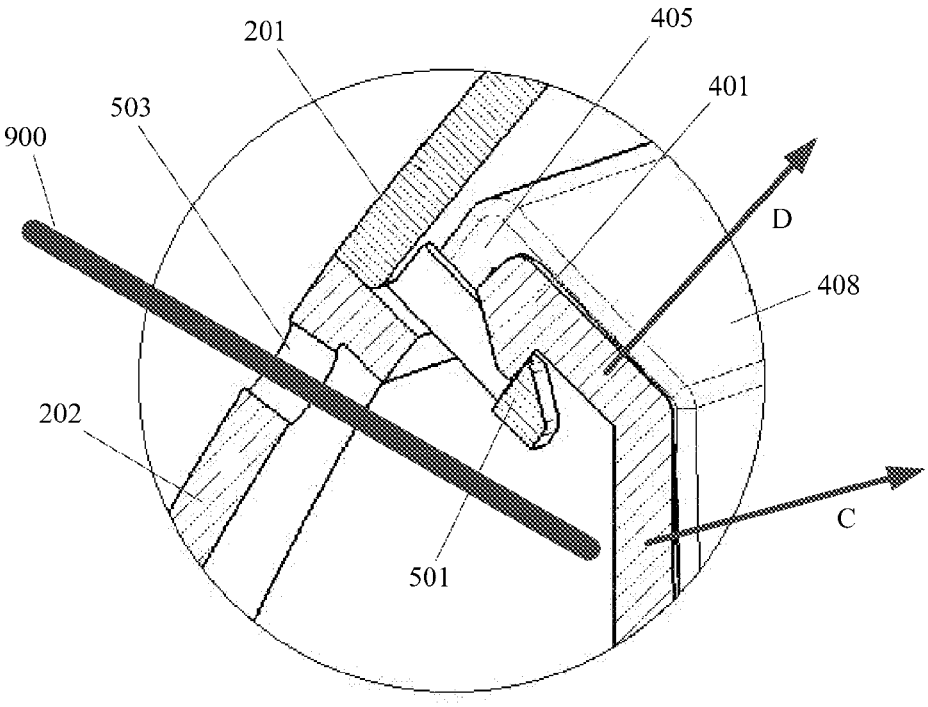
FIG. 11 is a close up view of FIG. 8, showing the insertion of a thin instrument through the disassembly hole to disassemble the control panel assembly.

The disassembly of the control panel assembly 101 is shown in FIG. 11. Disassembly may be performed by one or more operators, without having to move the laundry machine. To disassemble the control panel assembly 101, a long, thin instrument 900 such as a thin screw driver or small pin may be passed into the disassembly hole 503 which may be located on the curved back of the angled lower base part 202. The disassembly hole 503 may be positioned and shaped so that an object passing through it has a straight line path to a corresponding flexible hook 401. In some embodiments, the disassembly hole 503 has a circular shape and measures about 5 mm across, although in other embodiments the disassembly hole 503 may have various shapes (e.g., round, elliptical, triangular, or rectangular), and its size may be made according to the object that is to be passed through it. After insertion, the instrument 900 may be used to apply force or pressure to the lower arm of the flexible hook 401. In particular, the instrument 900 may apply force to a release section (e.g., notch), which may be designed to receive the instrument 900, of the lower arm of the flexible hook 401. Upon application of pressure by the thin instrument 900, the lower arm may move away from the disassembly hole 503 in the direction of arrow C. This motion may translate or impart motion to the upper arm of the flexible hook 401 in a slightly different direction D. This motion may cause the upper wedge part of the flexible hook 401 to slide past and away from the lower wedge part of the hook seat 501. At this point the flexible hook 401 is not bounded by the hook seat 501 and becomes unlatched. The upper fascia part 201 can then be easily disconnected from the angled lower base part 202 by sliding the upper fascia part 201 from off the angled lower base part 202 in a rear-upward direction.

In some embodiments, the thin instrument 900 may be a custom or proprietary device that is specially designed for the control panel assembly. The instrument 900 may have a particular shape, such as a diamond or star shape, that fits into the disassembly hole 503 while other devices are excluded because they do not fit. This specialized fit may insure that connection devices or delicate wiring or instrumentality within the control panel assembly 101 is not damaged by the insertion of an instrument through the disassembly hole 503. Additionally, the thin instrument 900 may include a device that regulates the stroke range of the thin instrument 900 (e.g., the distance that the thin instrument 900 may extend in through the disassembly hole 503). This regulation may allow precise deformation of the flexible hook 401 or hook seat 501 which in turn may allow easier disassembly of parts and minimize risk of breakage from over deformation. In some embodiments, the stroke regulating device of the thin instrument 900 may include a stopper larger than the disassembly hole 503 which may be located at a particular point on a shaft or handle of the thin instrument 900 to control the stroke length through the disassembly hole 503.

In addition to a unique shape to fit into the disassembly hole 503, the thin instrument 900 may have a custom tip that provides easier or safer disassembly of the control panel. This custom tip may contact the flexible hook 401 or hook seat 501 in a particular way so as to limit the pressure or deformation needed to unhook the connecting devices. For example, the thin instrument 900 may include a diamond shaped custom tip in which two sides of the diamond contact the upper and lower arms of the flexible hook 401 simultaneously. This contact may increase the friction between the parts and allow a successful de-seating of the flexible hook 401 from the hook seat 501 with minimal effort. Alternatively, the custom tip may hook a portion of the hook seat 501 and pull it away from the flexible hook 401 providing an alternate method of unlatching the connection devices. The custom tip may also be designed to allow the user to more easily or comfortably disconnect the parts while standing to the front of the machine, thereby allowing the user to perform maintenance on the appliance without moving the appliance. A custom thin instrument 900 may be attached to the laundry machine cabinet 102 or control panel assembly itself through the use of a clip or latch. Providing for the storage of the thin instrument 900 may lessen the risk of losing the thin instrument 900. Alternatively, the custom thin instrument 900 could be molded as an integral part of the control panel assembly. The thin instrument 900 may be bounded to the other part by a weak connection, allowing the user to break off the tool if maintenance is required. A molded-on thin instrument 900 could be attached to the laundry machine cabinet or control panel assembly part through the use of a clip or latch. This way, a technician or repairman desiring to perform maintenance on the appliance would have the tool close at hand, thereby eliminating the need to search for a suitable tool and reducing maintenance time.

In some embodiments, the disassembly hole 503 may be accompanied by a guiding device to ensure proper contact with a connecting device. For example, the guiding device may guide an instrument 900 toward a release section of an arm of the flexible hook 401. The guiding device may be connected to one or more points on the interior of either the upper fascia part 201 or the angled lower base part 202. This guiding device may form a hollow cone or pyramid shaped funnel with a wide end near or contacting the disassembly hole 503 and a narrow end near or contacting the flexible hook 401. In some embodiments, the guiding device may be integrated with the disassembly hole 503. For example, walls forming the disassembly hole 503 may function as the guiding device. The thin instrument 900 would be inserted into the guiding device after insertion into the disassembly hole 503. This funnel shape may direct the thin instrument 900 to a precise location on the flexible hook 401, leading to a precise application of pressure. This precision may increase the lifetime of the flexible hook 401 due to limiting pressure or harmful contact, as well as decreasing the effort needed to unlatch the flexible hook from the hook seat 501. Additionally, this guiding device might prevent the thin instrument 900 from contacting and damaging vulnerable wiring or instrumentality inside the control panel assembly 101. Alternatively, the guiding device may have a hollow cylindrical shape, and similarly limit the motion of the inserted thin instrument 900 within the control panel assembly 101. The presence of a guiding device may also increase the ease of contacting and pressuring the flexible hook 401 by an operator positioned in front of the control panel assembly 101 and may eliminate the need to move the appliance to perform maintenance. In various embodiments, the distance between the disassembly hole 503 and lower arm of the flexible hook 401 may be different. Shorter distances between the disassembly hole 503 and lower arm of the flexible hook 401 may assist the operator in contacting the lower arm with the thin instrument 900. In an example embodiment, the distance between the disassembly hole 503 and lower arm is approximately 25 mm.

Figure 12:
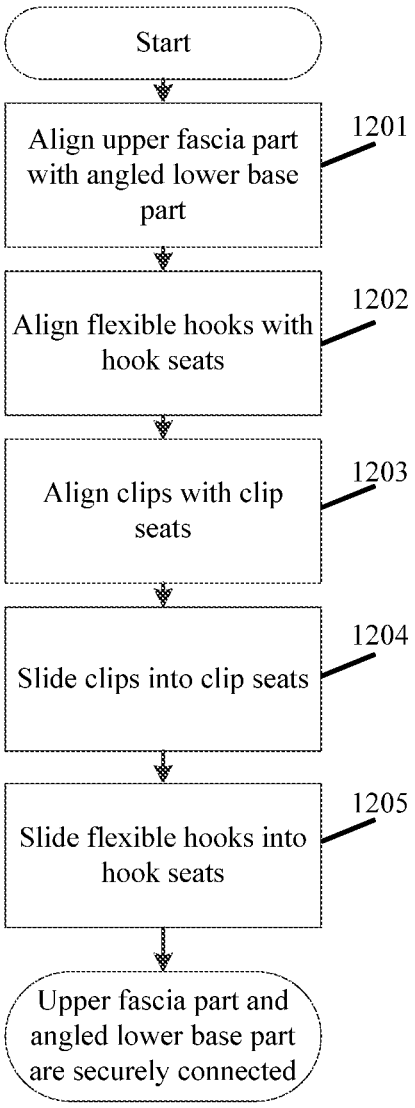
FIG. 12 is a flow diagram showing the assembly process for the control panel assembly.

FIG. 12 is a flow chart showing the assembly process for the control panel assembly 101. First, at step 1201, the upper fascia part 201 may be aligned with the angled lower base part 202. Next, the flexible hooks 401 may be aligned with the hook seats 501 at step 1202 and the clips 502 may be aligned with the clip seats 402 at step 1203. The upper fascia part 201 may then be slid down at an angle onto the angled lower base part 202, which causes the clips 502 to slide into the clip seats 402 at step 1204 and the hook seats 501 to slide onto the flexible hooks 401 at step 1205. As a result, the upper fascia part 201 and lower base part 202 may be securely connected and the outside surfaces of both parts may be lined up flush against each other. At this stage, the control panel assembly 101 may be considered to be assembled.

Figure 13:
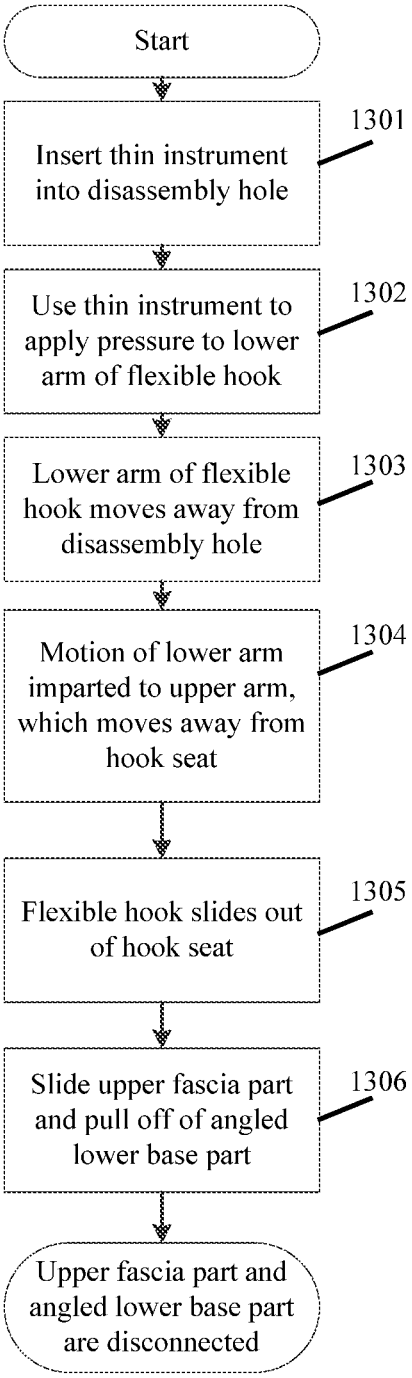
FIG. 13 is a flow diagram showing the disassembly process for the control panel assembly.

FIG. 13 is a flow chart showing the disassembly process for the control panel assembly 101. To begin, in step 1301, a long, thin instrument 900 such as a screw driver or pin may be inserted into the disassembly hole 503. The thin instrument 900 may then be used to apply pressure to the lower arm of the flexible hook 401 at step 1302. This pressure may cause the lower arm of the flexible hook 201 to move away from the disassembly hole 503 at step 1303. The motion of the lower arm may translate or impart motion to the upper arm in a slightly different direction away from the hook seat 501 at step 1304. This may cause the tip of the flexible hook 401 to slide out of the hook seat 501 at step 1305 and the flexible hook 401 and hook seat 501 may be separated. The upper fascia part 201 may then be removed from off the angled lower base part 202 by sliding the upper fascia part 201 in a rear-upward direction and pulling the upper fascia part 201 off of the angled lower base part 202 at step 1306. At this stage, the control panel assembly 101 may be considered to be disassembled.

Although examples described herein pertain to a laundry machine 100, aspects of the disclosure may be incorporated on other appliances. For example, a manner in which the control panel assembly 101 may be attached to the laundry machine cabinet 102 may be carried over to attach control panels to other appliances.

The present invention has been described in terms of preferred and exemplary embodiments thereof. Numerous other embodiments, modifications, and variations within the scope and spirit of the appended claims will be understood by persons of ordinary skill in the art from the review of this disclosure.

What is claimed is:

1. An appliance control panel assembly, comprising:

an angled lower base part removably attached to an outside wall portion of an appliance cabinet;

an upper fascia part, comprising at least one command input device, wherein the upper fascia part is configured to slidably engage with the angled lower base part so that, when latching the upper fascia part to the angled lower base part, the upper fascia part slides downward along the angled lower base part at an angle between 0 and 90 degrees towards a front of the appliance cabinet to which the appliance control panel assembly is attached;

at least one coupling device configured to releasably latch the upper fascia part with the angled lower base part as a result of the upper fascia part slidably engaging the angled lower base part, and to unlatch the upper fascia part from the angled lower base part to allow the upper fascia part to be removed from the angled lower base part while the angled lower base part remains attached to the appliance cabinet; and a fastener configured to attach the angled lower base part to the outside wall portion of the appliance cabinet in a manner that allows the angled lower base part and the upper fascia part to remain latched together when the angled lower base part is removed from the outside wall portion of the appliance cabinet, wherein the fastener is different from the at least one coupling device.

2. The appliance control panel assembly of claim 1, wherein the at least one coupling device comprises a flexible hook and a hook seat.

3. The appliance control panel assembly of claim 2, wherein the flexible hook is resiliently deformable.

4. The appliance control panel assembly of claim 2, wherein the flexible hook protrudes from the upper fascia part and is configured to be inserted into a hook seat of the angled lower base part.

5. The appliance control panel assembly of claim 2, wherein the flexible hook protrudes from the angled lower base part and is configured to be inserted into a hook seat of the upper fascia part.

6. The appliance control panel assembly of claim 2, wherein the flexible hook is integrally formed with at least one of the upper fascia part and the angled lower base part.

7. The appliance control panel assembly of claim 2, wherein the hook seat is integrally formed with at least one of the upper fascia part and the angled lower base part.

8. The appliance control panel assembly of claim 2, wherein the flexible hook comprises a first inclined surface and the hook seat comprises a second inclined surface, and wherein the first inclined surface and second inclined surface are configured to slidably engage each other and to flex the flexible hook.

9. The appliance control panel assembly of claim 2, wherein a width of an opening in the hook seat is slightly larger than a width of a tip end of the flexible hook so that the hook seat is configured to hold the flexible hook and regulate movement of the flexible hook.

10. The appliance control panel assembly of claim 2, wherein the flexible hook comprises:

a first arm part protruding from the angled lower base part in a first direction;

a second arm part continuing from the first arm part and extending in a second direction; and a tip end positioned at an end of the second arm part and configured to latch to the hook seat.

11. The appliance control panel assembly of claim 10, wherein the first arm part is configured to flex when pressed.

12. The appliance control panel assembly of claim 10, wherein the first arm part is longer than the second arm part.

13. The appliance control panel assembly of claim 10, wherein the second arm part is longer than the first arm part.

14. The appliance control panel assembly of claim 10, wherein the first arm part is thicker than the second arm part.

15. The appliance control panel assembly of claim 10, wherein the second arm part is thicker than the first arm part.

16. The appliance control panel assembly of claim 1, wherein the angled lower base part forms at least one disassembly hole through the angled lower base, the at least one disassembly hole being separate from the at least one coupling device and providing access to the at least one coupling device for releasing the upper fascia part from the angled lower base part while the upper fascia part is latched to the angled lower base part and the angled lower base part is attached to the outside wall portion of the appliance cabinet.

17. The appliance control panel assembly of claim 16, wherein the at least one disassembly hole is disposed on a back wall of the angled lower base part to allow a straight object passing through the at least one disassembly hole to move an arm of the at least one coupling device to release the upper fascia part from the angled lower base part.

18. The appliance control panel assembly of claim 16, wherein the at least one disassembly hole is disposed in a position where an object passing through the disassembly hole has a straight line path to the at least one coupling device such that the object has access to the at least one coupling device to release the upper fascia part from the angled lower base part.

19. The appliance control panel assembly of claim 18, wherein the at least one disassembly hole is configured to guide the object passing through the disassembly hole to a release section of the at least one coupling device that causes the at least one coupling device to release the upper fascia part from the angled lower base part.

20. The appliance control panel assembly of claim 1, wherein the at least one coupling device comprises a plurality of coupling devices, wherein the angled lower base part forms a plurality of disassembly holes separate from the plurality of coupling devices, and wherein a number of the disassembly holes equals a number of the coupling devices.

21. The appliance control panel assembly of claim 1, wherein the angle is between approximately 25 and 80 degrees.

22. The appliance control panel assembly of claim 1, wherein the upper fascia part is configured to slidably engage with the angled lower base part so that, when releasing the upper fascia part from the angled lower base part, the upper fascia part slides upward along the angled lower base part at a second angle between 0 and 90 degrees towards a rear of the appliance cabinet to which the appliance control panel assembly is attached.

23. The appliance control panel assembly of claim 22, wherein the second angle is between approximately 25 and 80 degrees.

24. An appliance, comprising:

a cabinet;

an angled lower base part removably attached to an outside wall portion of the cabinet;

an upper fascia part, comprising at least one command input device, wherein the upper fascia part is configured to slidably engage with the angled lower base part so that, when latching the upper fascia part to the angled lower base part, the upper fascia part slides downward along the angled lower base part at an angle between 0 and 90 degrees towards a front of the appliance;

at least one coupling device configured to releasably latch the upper fascia part with the angled lower base part as a result of the upper fascia part slidably engaging the angled lower base part, and to unlatch the upper fascia part from the angled lower base part to allow the upper fascia part to be removed from the angled lower base part while the angled lower base part remains attached to the cabinet; and a fastener configured to attach the angled lower base part to the outside wall portion of the cabinet in a manner that allows the angled lower base part and the upper fascia part to remain latched together when the angled lower base part is removed from the outside wall portion of the cabinet, wherein the fastener is different from the at least one coupling device.

25. An appliance, comprising:

a cabinet; and a control panel assembly comprising:

an angled lower base part comprising one or more fastener portions for facilitating attachment of the angled lower base part to the cabinet and one or more disassembly holes;

an upper fascia part configured to slidably engage the angled lower base part so that, when latching the upper fascia part to the angled lower base part, the upper fascia part slides downward along the angled lower base part at an angle between 0 and 90 degrees towards a front of the appliance, the upper fascia part comprising an input device that allows a user to interface with the appliance; and one or more coupling devices configured to:

releasably latch the upper fascia part with the angled lower base part as a result of the upper fascia part slidably engaging the angled lower base part; and in response to an object passing through the one or more disassembly holes and respectively contacting the one or more coupling devices, unlatch the upper fascia part from the angled lower base part to allow the upper fascia part to slidably disengage from the angled lower base part while the angled lower base part remains attached to the cabinet.

26. The appliance of claim 25, wherein the angle is between approximately 25 and 80 degrees.

* * * * *